US005201428A

United States Patent [19]

Pasinski et al.

[11] Patent Number: 5,201,428

[45] Date of Patent: Apr. 13, 1993

[54] NAPKIN HOLDER

[75] Inventors: Irene Pasinski; William J. Kolano; Lorraine Opperman, all of Pittsburgh, Pa.

[73] Assignee: Hutzler Manufacturing Company, Inc., Canaan, Conn.

[21] Appl. No.: 347,334

[22] Filed: May 3, 1989

[51] Int. Cl.[5] ..... A47F 5/00

[52] U.S. Cl. ..... 211/50; 211/43; 211/175

[58] Field of Search ..... 211/50, 43, 175

[56] References Cited

U.S. PATENT DOCUMENTS 1,750,576 3/1930 Cubberley ..... 211/43 X
2,294,595 9/1942 Dice ..... 211/43
3,844,415 10/1974 Heimann ..... 211/43
4,535,896 8/1985 Evenson ..... 211/43 X
4,874,099 10/1989 Arnott et al. ..... 211/50

FOREIGN PATENT DOCUMENTS 22741 6/1883 Fed. Rep. of Germany ..... 211/43
2051841 4/1972 Fed. Rep. of Germany ..... 211/43

*Primary Examiner*—Robert W. Gibson, Jr.
*Attorney, Agent, or Firm*—Michael J. Striker

[57] ABSTRACT

A napkin holder comprises two main parts engageable with one another and provided with substantially vertical walls defining an inner space therebetween, the main parts being movable relative to one another between a plurality of positions so as to adjust a width of the inner space between the walls.

5 Claims, 3 Drawing Sheets

FIG. 1
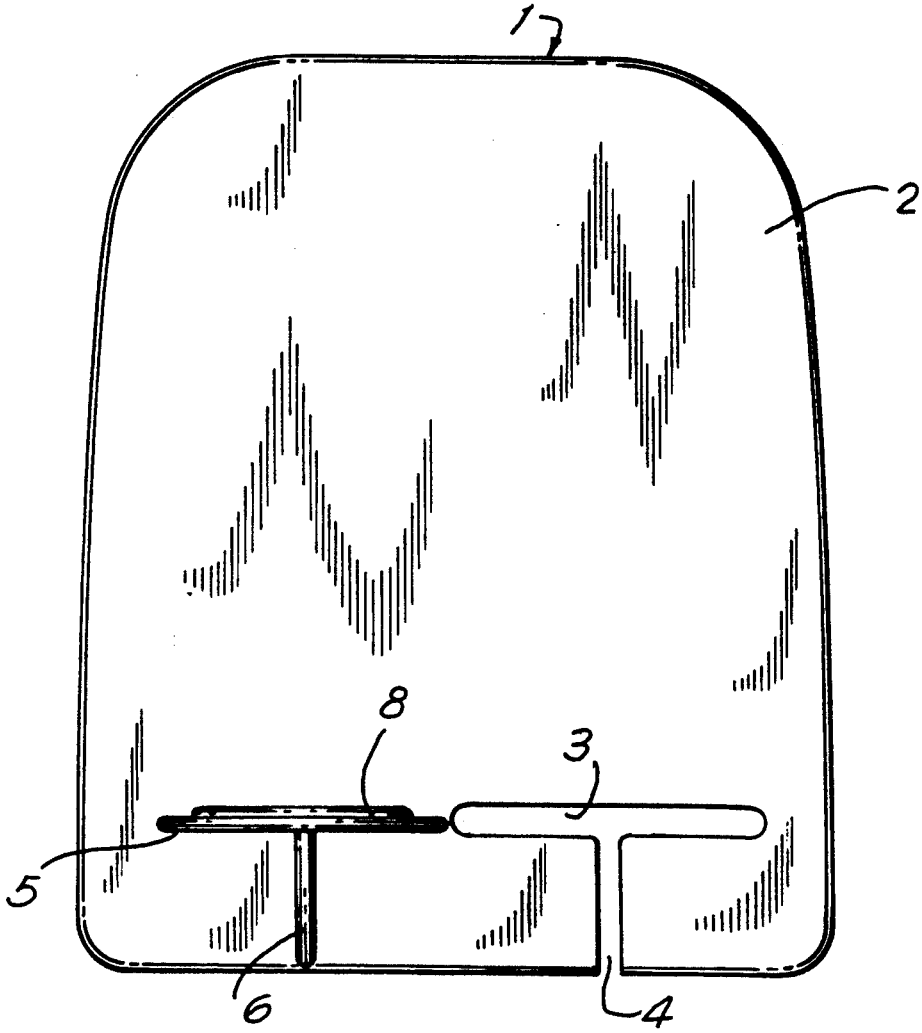
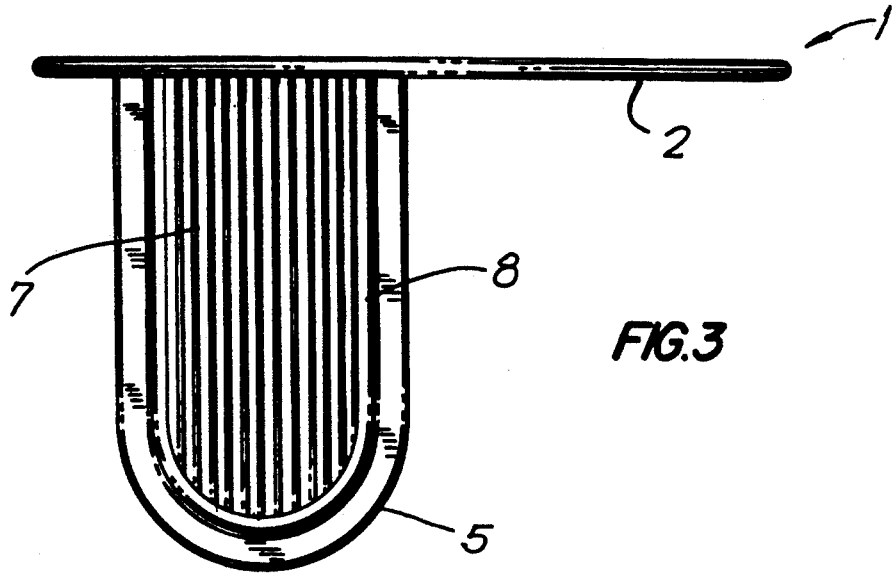
FIG. 3

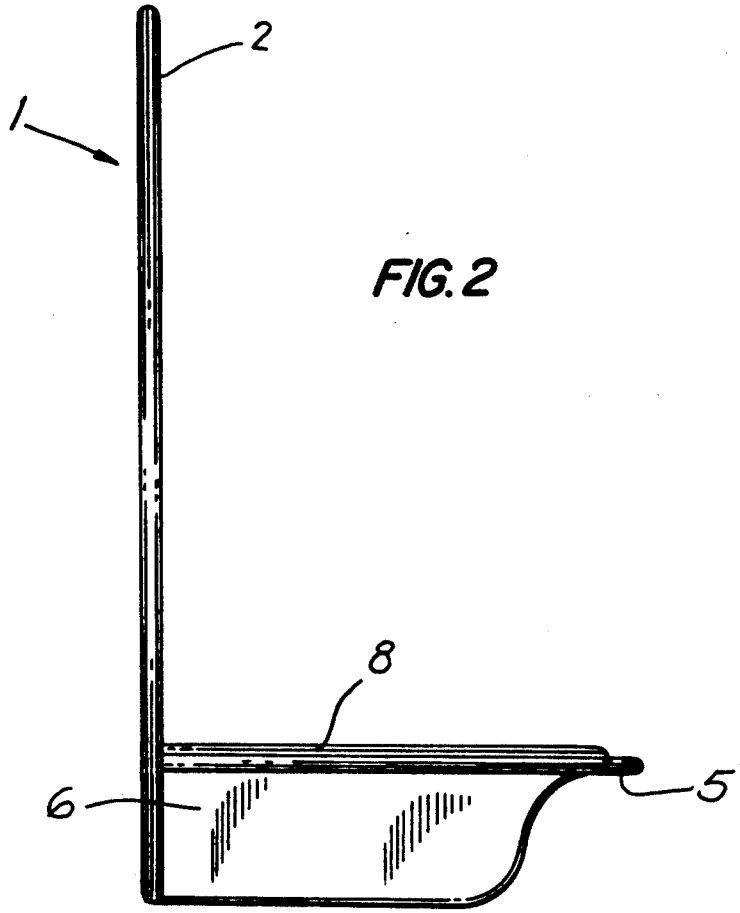
FIG. 2
FIG. 5
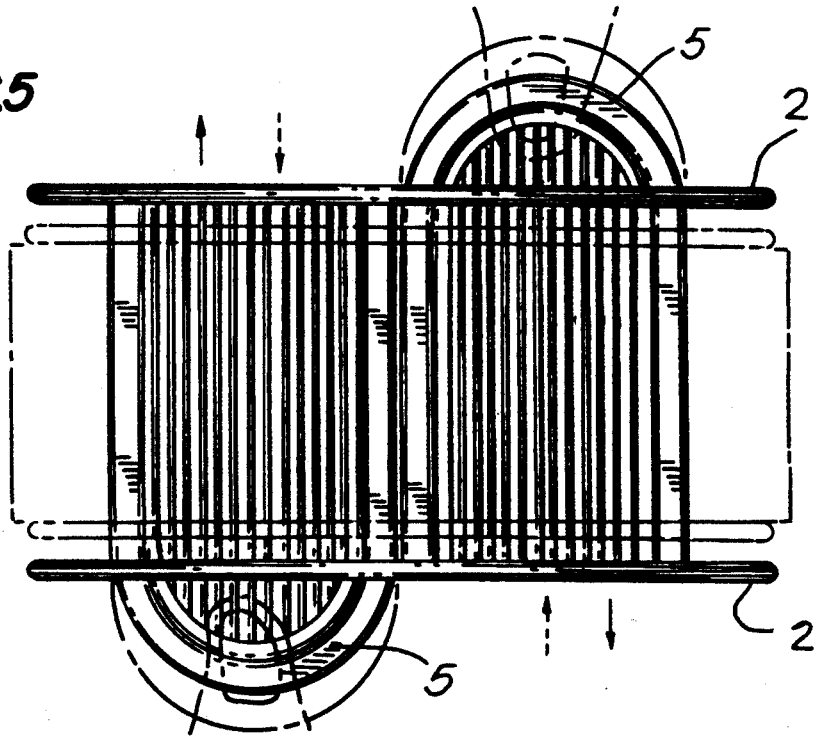

NAPKIN HOLDER

BACKGROUND OF THE INVENTION

The present invention generally relates to napkin holders.

Napkin holders are in the art and used in a variety of designs for holding napkins or similar household items. A known napkin holder is a structure which includes two side walls defining an inner space in which napkins can be held. The inner space in the known napkin holders is not adjustable. Therefore, when the number of napkins in the holder reduces they are no longer firmly held between the vertical walls and hang loosely in the inner space. Not only the appearance of such napkins is unpleasant, and also they can fall out of the napkin holder. It is believed to be understood that it would be advisable to improve the napkin holder in the above-mentioned sense.

SUMMARY OF THE INVENTION

Accordingly, it is an object of the present invention to provide a napkin holder which avoids the disadvantages of prior art.

In keeping with these objects and with others which will become apparent hereinafter, one feature of the present invention resides, briefly stated, in a napkin holder which has substantially vertical walls defining an inner space therebetween for holding napkins, wherein said walls are engageable with one another and movable relative to one another between a plurality of positions so as to change a width of the inner space between them.

When the napkin holder is designed in accordance with the present invention, the inner space for holding the napkins in the holder can be adjusted in accordance with the number of napkins to be held. Therefore, at any time regardless of the number of napkins, they are held firmly between the vertical walls of the napkin holder.

The novel features which are considered as characteristic for the invention are set forth in particular in the appended claims. The invention itself, however, both as to its construction and its method of operation, together will additional objects and advantages thereof, will be best understood from the following description of specific embodiments when read in connection with the accompanying drawings.

BRIEF DESCRIPTION OF THE DRAWINGS

FIG. 1 is a front view of one part of a napkin holder in accordance with the present invention;

FIG. 2 is a side view of the part shown in FIG. 1;

FIG. 3 is a plan view of the part shown in FIG. 1;

FIG. 5 is a top view showing the inventive napkin holder in assembled condition.

DESCRIPTION OF THE PREFERRED EMBODIMENTS

Figure 4:
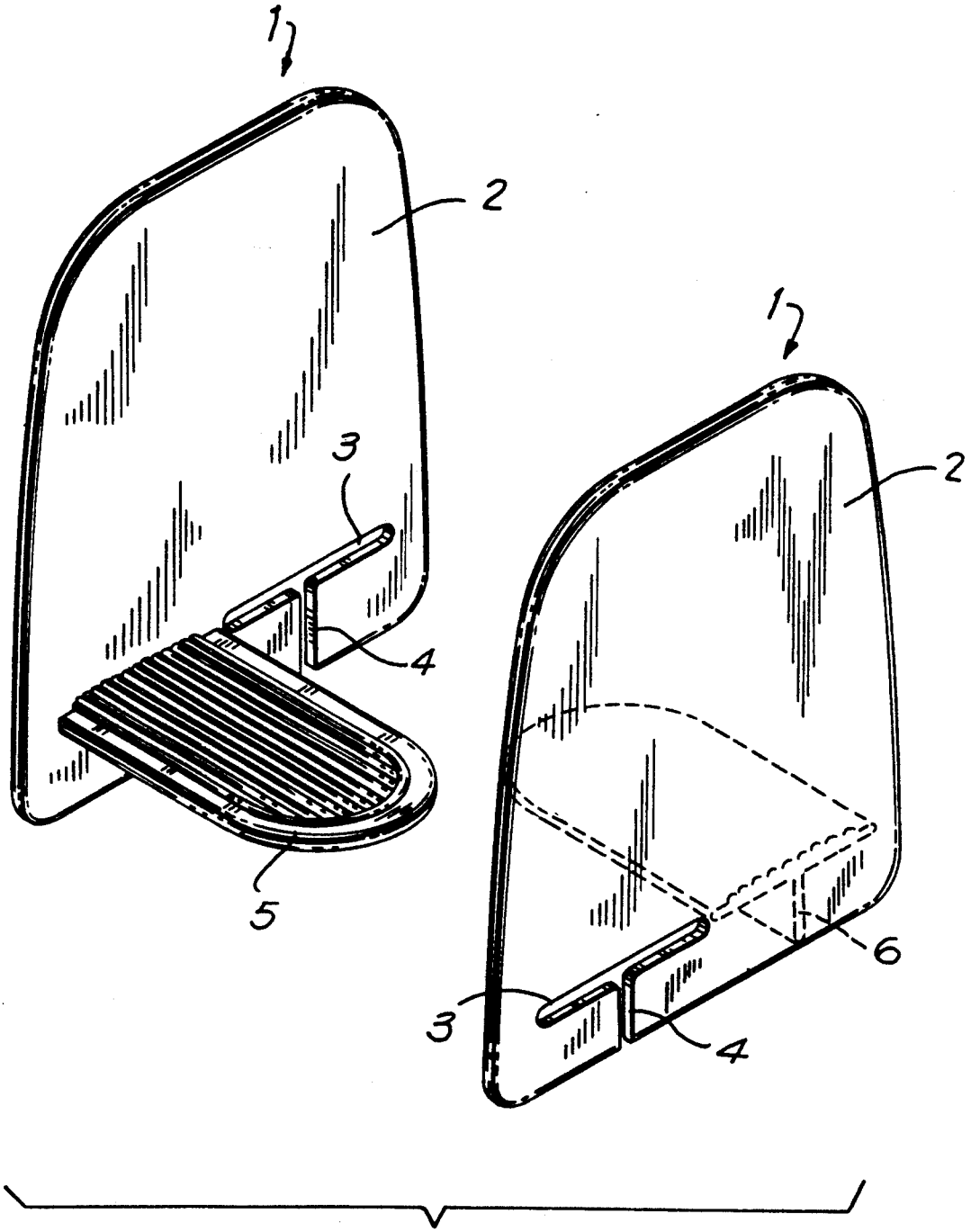
FIG. 4 is a exploded view showing a napkin holder in accordance with the present invention in an disassembled condition.

A napkin holder in accordance with the present invention has two main parts which are identified as a whole with reference numerals 1 and 1'. Since these parts are identical, only one part 1 will be discussed hereinbelow in detail.

The main part of the inventive napkin holder is a substantially vertical wall 2. The wall 2 has a horizontal slot 3 and a vertical slot 4. The vertical slot 4 extends downward communicates with the horizontal slot 3 and opens at the lower surface of the vertical wall 2. Laterally of the horizontal slot at a distance spaced from the lower surface, the wall is provided with a substantially horizontal projection. A substantially vertical projection 6 extends downward from the horizontal projection 5. The width and height of the horizontal projection 5 are insignificantly smaller than the width and height of the horizontal slot 3. The width of the vertical projection 6 is insignificantly smaller than the width of the vertical slot 4. The vertical projection 6 is connected at its upper end, the horizontal projection 5 and extends almost over the whole length of the latter, as shown in FIG. 2.

The projections 5 and 6 can be formed integrally of one-piece with the wall 2, and the whole unit can be composed for example of synthetic plastic material. The upper surface of the projection 5 can be provided with a plurality of longitudinal ribs to imporove holding of napkins or other household items. The ribs which are identified with reference numeral 7 can be surrounded by an upstanding limiting flange 8 which is also provided on the upper surface of the horizontal projection 5. The main parts 1 and 1' of the napkin holder can be completely identical to one another.

In operation as best seen in FIG. 5 the horizontal projection 5 and the vertical projection 6 of the main part 1 engages in the horizontal slot 3 and the vertical slot 4 of the main part 1' with a sliding fit, and vice versa. The main parts 1 and 1' can move relative to one another in direction of the arrow A so as to adjust the distance between the main parts 1 and 1' or in other words, a space limited by these parts, for example depending on the number of napkins are always firmly held between the vertical walls of the main parts. The portions of the horizontal projections 6, which extends outwardly beyond the vertical walls 2 in the position shown in FIG. 4 are used as grasping portions to be grazed by a user for moving the main parts toward one another or away of one another.

It will be understood that each of the elements described above, or two or more together, may also find a useful application in other types of constructions differing from the types described above.

While the invention has been illustrated and described as embodied in a napkin holder, it is not intended to be limited to the details shown, since various modifications and instructural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A napkin holder comprising first and second main parts engageable with one another and having, respectively, first and second vertical walls defining an inner space therebetween, and first and second horizontal projections for supporting a stack of napkins in said inner space, each of said first and second vertical walls having a lower surface, said first and second projections extending from said first and second walls, respectively, at a same predetermined distance from a respective lower surface, and each of said first and second walls having an opening at said predetermined distance laterally spaced from a respective one of said first and second projections for slidably receiving another one of said first and second projections whereby said inner space is adjusted in accordance with a quantity of napkins in the stack of napkins; each of said first and second main parts comprising a vertical projection extending downward from a respective one of said first and second horizontal projections, and each of said first and second walls comprising a slot extending downward from a respective opening for slidably receiving a respective vertical projection, said slot opening at the lower surface of a respective one of said first and second vertical walls; said vertical projection extending downward a distance equal to said predetermined distance, and being connected to a respective one of said first and second horizontal projections along an entire length of said respective one of said first and second horizontal projections.

2. A napkin holder as set forth in claim 1, wherein each of said first and second vertical walls, each of said first and second horizontal projections, respectively, and a respective vertical projection are formed integrally with each other.

3. A napkin holder as set forth in claim 1, wherein said first and second main parts are identical to one another.

4. A napkin holder as set forth in claim 1, wherein each of said first and second horizontal projections has an upper surface provided with a plurality of ribs and an upstanding flange for outwardly limiting said ribs.

5. A napkin holder as set forth in claim 1, wherein each of said first and second horizontal projections has a free rounded end located opposite to a respective one of said first and second vertical walls.

* * * * *